United States Patent [19]

Hanson

[11] Patent Number: 5,014,359

[45] Date of Patent: May 14, 1991

[54] VEST AND BACKPACK COMBINATION

[75] Inventor: James M. Hanson, Quinhagak, Ak.

[73] Assignee: Wally Miller, Olympia, Wash.

[21] Appl. No.: 336,203

[22] Filed: Apr. 10, 1989

[51] Int. Cl.[5] ..... A41D 1/04

[52] U.S. Cl. ..... 2/94; 2/102

[58] Field of Search ..... 2/69, 72, 74, 86, 89, 2/92, 94, 95, 102, 103, 213, 215, 247, 249, 250, 251, 253; 190/107; 224/151, 205

[56] References Cited

U.S. PATENT DOCUMENTS 4,637,075 1/1987 Ingrisano et al. ..... 2/102

4,669,127 6/1987 Swanson ..... 2/102

*Primary Examiner*—Werner H. Schroeder

*Assistant Examiner*—Gloria Hale

*Attorney, Agent, or Firm*—T. W. Secrest

[57] ABSTRACT

This invention is directed to a vest and backpack combination which can be adjusted to fit people of different sizes and configurations. In fact, the combination can be adjusted so that a person wearing the combination need not have anything between the persons's body and the combination or the person wearing the combination can have a jacket or a mackenole or a shirt between the wearer and the combination. This combination is useful for hunters, fisherman, backpacker and military personnel for carrying equipment such as fish hooks, food, dry clothes such as socks, and ammunition.

27 Claims, 6 Drawing Sheets

VEST AND BACKPACK COMBINATION

THE BACKGROUND OF THE INVENTION

Many people are active in the outdoors and like to get to the outdoors for recreational activities and also for work. Fisherman, hunters, backpackers, hikers, soldiers and construction workers and loggers are in the outdoors a considerable amount of the time. Often, there is needed a garment for carrying items.

A fisherman may want fish hooks, a fish line, dry socks, a knife, matches, a compass and some food.

A hunter may want ammunition, a knife, matches, dry socks, a compass, food and a cap.

A backpacker may want food, a blanket, matches, a compass, dry socks, a knife and a cap.

A hiker may want food, matches, a knife, compass, dry socks and a cap.

A soldier may want a knife, ammunition, hand grenades, matches, food, a compass, dry clothing, and maybe a walkie-talkie communication outfit.

A construction worker may want a garment having facilities for carrying tools.

A logger may want a garment for carrying tools for sharpening an axe or a chainsaw, and maybe a cap.

An objective is to provide a garment which can satisfy the needs of these various people. The garment should have a minimum number of sizes such as two sizes. With a properly designed garment two sizes should accommodate a wide range of people of various shapes and configurations. Another desirable feature is to have a garment which is waterproof but allows the circulation of air.

THE GENERAL DESCRIPTION OF THE INVENTION

This invention is directed to a general purpose vest and back pack combination which can be used by people of various occupations and desires such as a hunter, a hiker, a fisherman, a backpacker, a soldier, a construction worker and a logger.

The vest and backpack combination is unitary and comprises a back panel and two front or side panels. It is possible by having the back panel and the two front panels to adjust the vest to various sizes to accommodate the wearer of different sizes.

The combination can comprise a detachable pouch on the back panel so as to have variable load vest and backpack combination.

There are numerous pockets on the combination for holding fishing hooks, a knife, a fish line, ammunition, matches, needle and thread, first aid articles and a compass to name a few.

Also, because of the unitary construction of the back portion and two front portions, the vest and backpack combination can have a snug fit or a loose fit depending upon the desire of the wearer of the combination.

The material of construction should be moisture resistant so as to preclude the passage of moisture thru the combination and yet should allow air to flow thru the combination.

There is also provided a seat pad so that when a person sits down the seat pad keeps the person from getting wet.

THE DRAWINGS

In the drawings it is seen:

Figure 6:
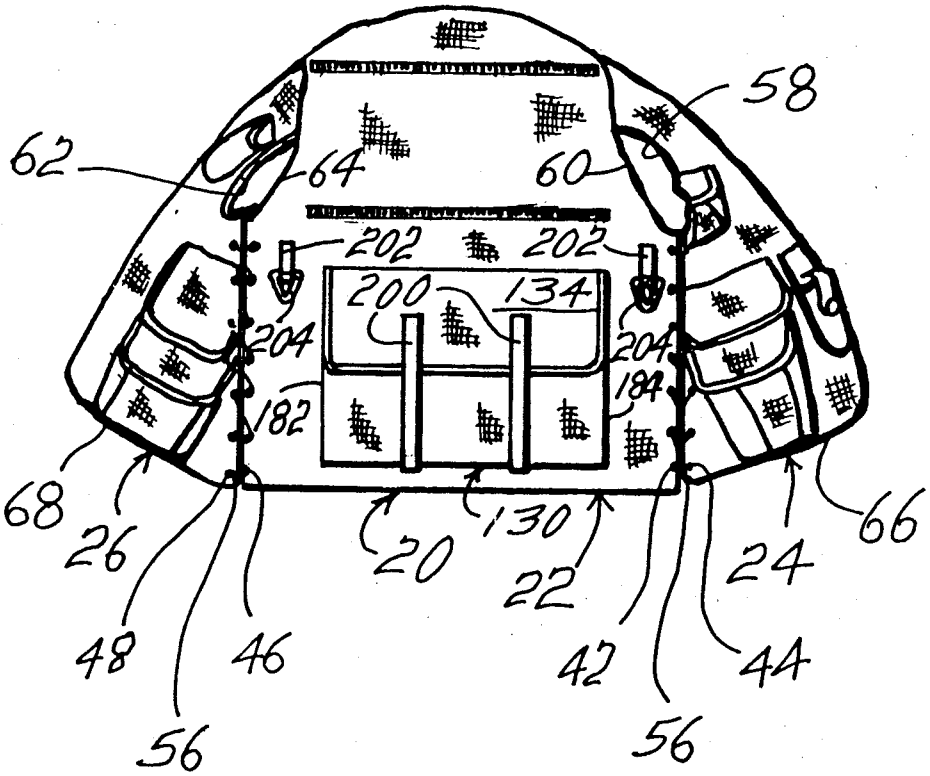
Figure 5:
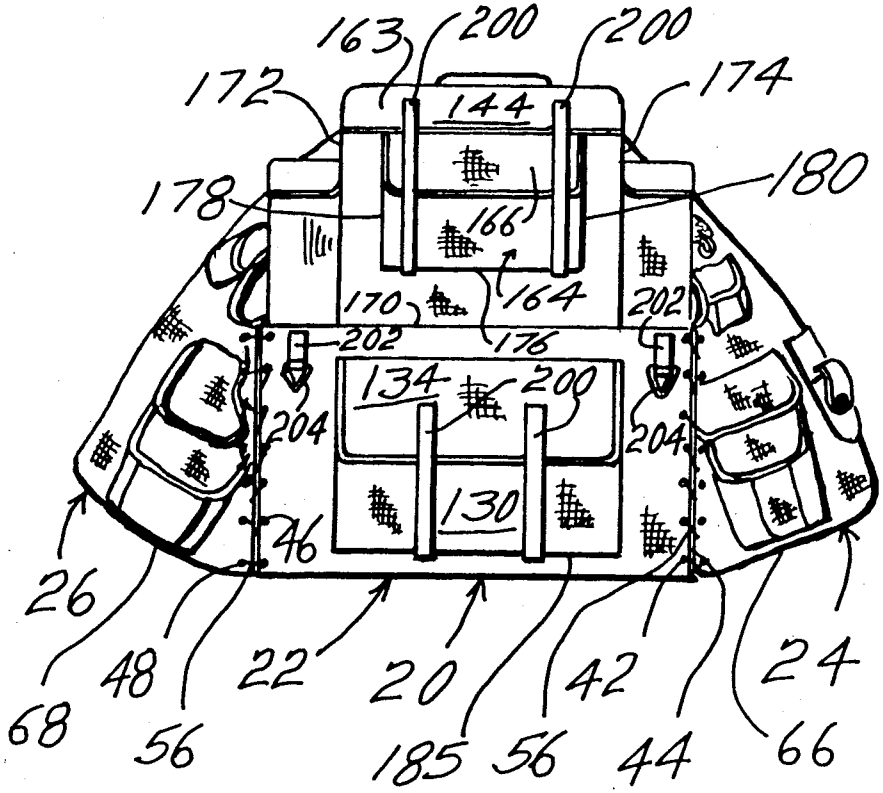
FIG. 5 is a view of the outside of the vest and the backpack combination and illustrates the main panel and the two front panels attached by laces to the sides of the main panels and with the packs and the pockets closed.
Figure 7:
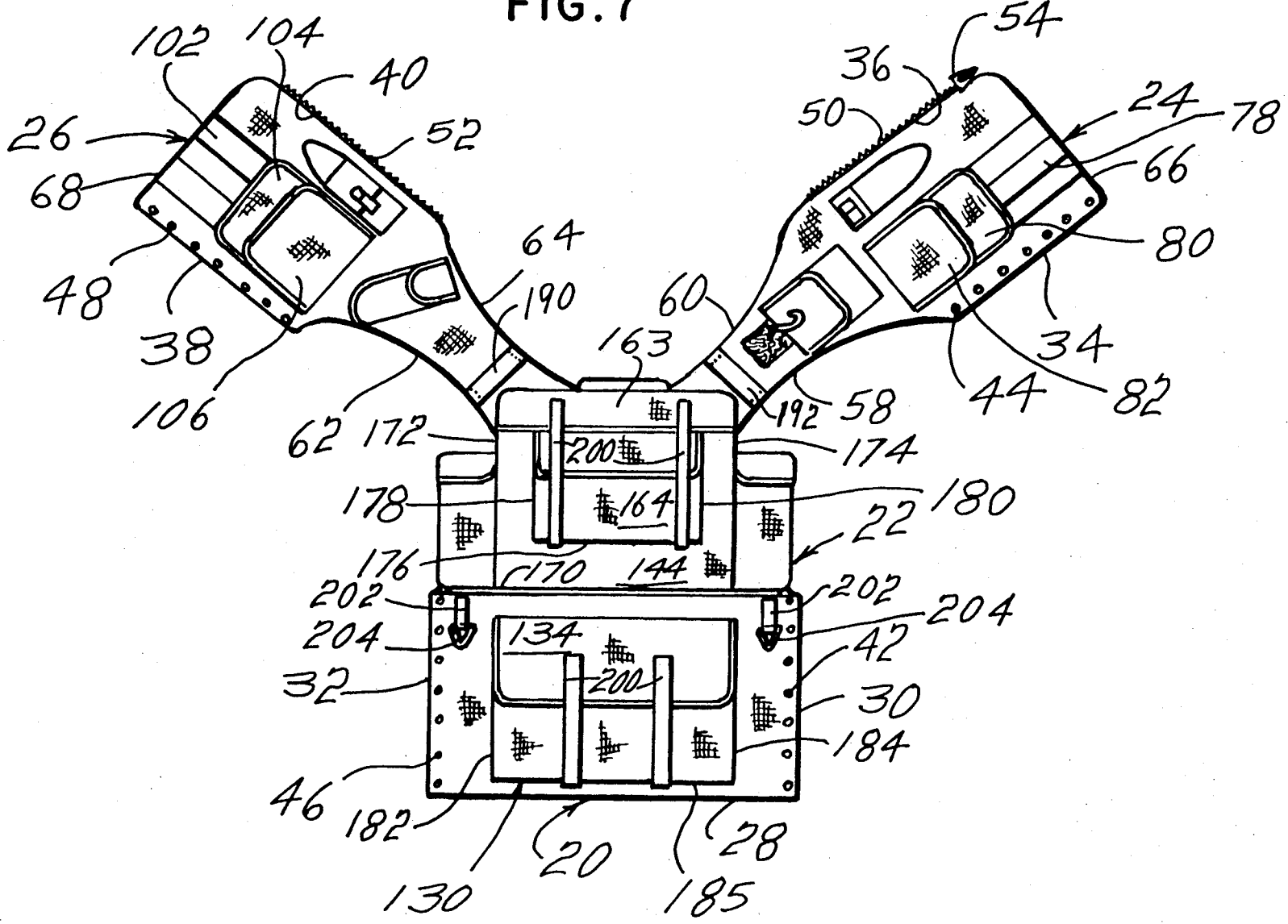
Figure 8:
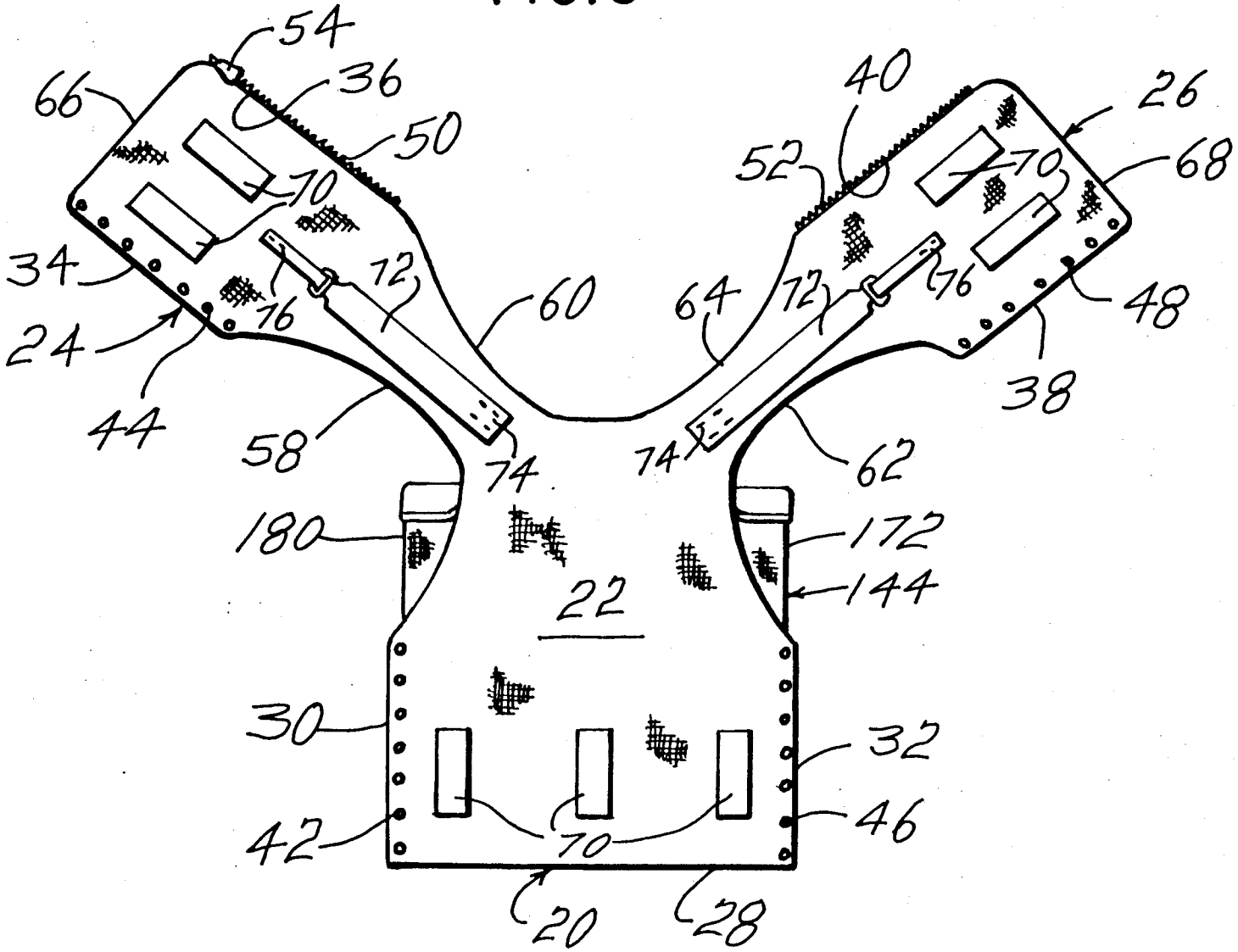
Figure 11:
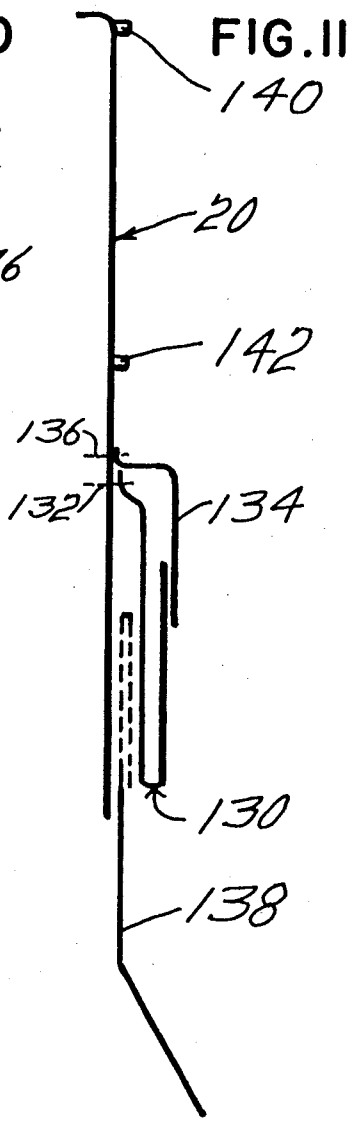
Figure 10:
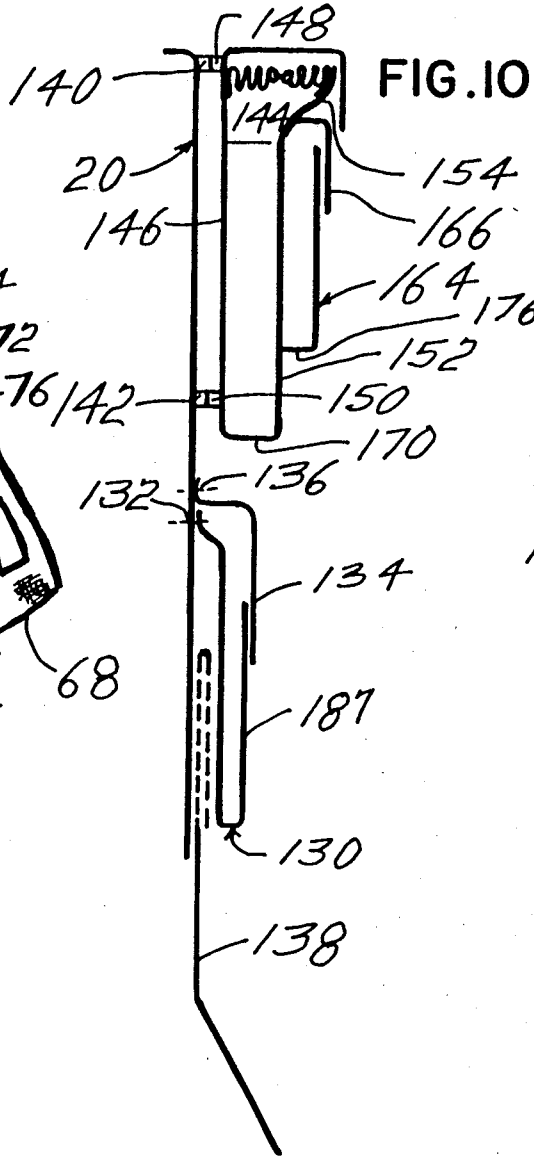
Figure 9:
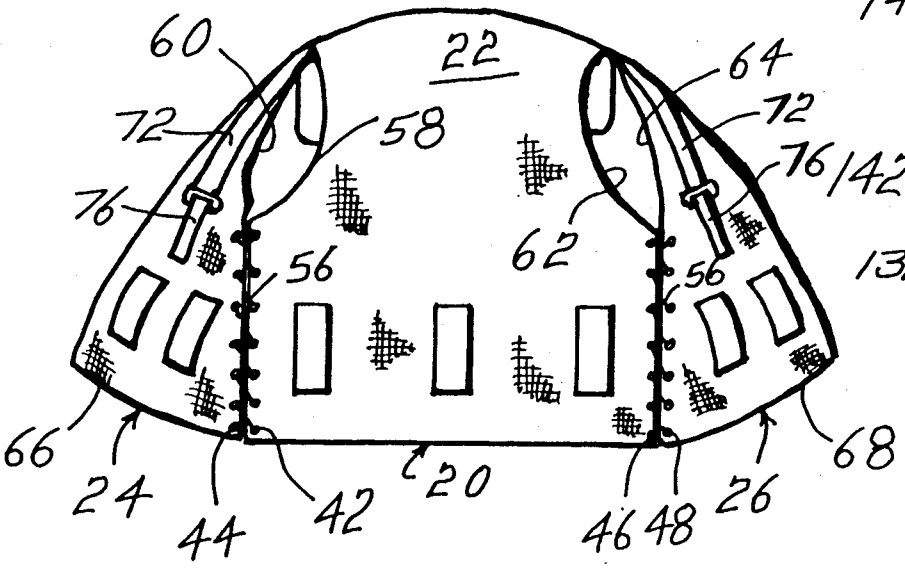
Figure 12:
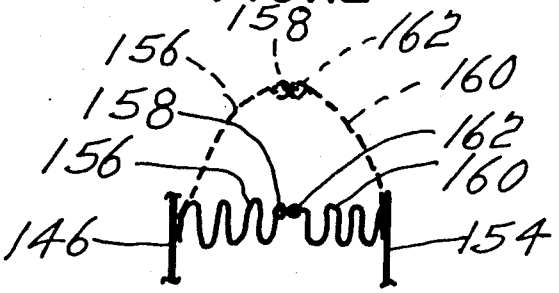

FIG. 6 is a view of the outside of the vest and backpack combination and illustrates the main panel the two front panels attached by laces to the sides of the main panel and with the upper pack removed from the back panel and the other pack and the pockets closed FIG. 7 is a view of the outside of the vest and the backpack combination and with the laces removed, and illustrates the main panel or the back panel and the two front panels in an outstretched position and in the configuration of a "Y";

FIG. 8 is a view of the inside of the vest and the backpack combination with the laces removed, and illustrates the main panel or the back panel and the two front panels in an outstretched position and in the configuration of a "Y";

FIG. 9 is a view of the inside of the vest and the backpack combination with laces joining the two front panels to the main panel or the back panel;

FIG. 10 is a schematic side elevational view of the main panel or the back panel of the vest and backpack combination, and illustrates the two packs, in a closed state, and a downwardly directed fanny pad;

FIG. 11 is a schematic side elevational view of the main panel or the back panel of the vest and backpack combination and illustrates the lower pack and a downwardly directed fanny pad; and, FIG. 12 is a schematic fragmentary side elevational view of the keeper in the upper part of the upper pack as illustrated in FIG. 10.

THE SPECIFIC DESCRIPTION OF THE INVENTION

With reference to the drawings it is seen that reference number 20 is for the vest and backpack combination. The combination 20, with reference to FIG. 8, comprises a back panel or a main panel 22, a right front panel 24 and a left front panel 26. FIG. 8 is a view of the inside of the combination 20 with the back panel 22, the right front panel 24 and the left front panel 26 in an outstretched position and in the configuration of a "Y".

The back panel 22 has a lower edge 28, a right side edge 30 and a left side edge 32.

The right front panel 24 has an inner side 34 which can be adjustably attached to the back panel 22 and a free side 36. The left front panel 26 has an inner side 38 which can be adjustably attached to the back panel 22 and a free side 40.

In the right side 30 of the back panel 22 there are eyelets 42.

Near the inner side edge 34 of the right front panel 24 there are eyelets 44.

In the left side 32 of the back panel 22 there are eyelets 46.

Near the inner side edge 38 of the left front panel 26 there are eyelets 48.

On the free side 36 of the left front panel 24 there is the first part of a zipper 50. On the free side 40 of the left front panel 26 there is the second part of a zipper 52. A keeper 54 is attached to the first part of the zipper 50 for joining together and for separating the first part 50 from the second part 52.

In FIG. 9 it is seen that a lace 56 joins the eyelets 42 and 44. Also, in FIG. 9 it is seen that a lace 56 joins the eyelets 46 and 48.

In FIG. 8 it is seen that an inwardly curved side 58 joins the back panel 22 with the right front panel 24. The inwardly curved side 58 is for the right shoulder and the right side of the person wearing the combination 20. Also, in FIG. 8 it is seen that there is inwardly curved side 60 joining the right front panel 24 and the upper part of the back panel 22. The inwardly curved side is that portion of the combination 20 near the neck of the wearer and over the shoulder of the wearer.

In FIG. 8 it is seen that there is a inwardly curved side 62 joining the back panel 22 and the left front panel 26. The inwardly curved side 62 is in the shoulder region and also the side region of the wearer. In FIG. 8 it is seen that there is an inwardly curved side 64 joining the upper part of the back panel 22 and the left front panel 26. This inwardly curved side 64 is near the neck of the wearer and the left shoulder of the wearer of the combination 20.

On the outer part of the right front panel 24 there is a lower edge 66. On the outer part of the left front panel 26 there is a lower edge 68.

In the lower part and in the inside of the back panel 22 there are three belt loops 70. In the outer part and in the inside of the right front panel 24 there are two belt loops 70. In the outer part and in the inside of the left front panel 26 there are two belt loops 70. It is possible to pass a belt thru these belt loops 70 so as to cinch tightly around the wearer the back panel 22, the right front panel 24 and the left front panel 26.

In that part of the right front panel 24 near the inwardly curved side 58 and the inwardly curved side 60 there is an adjustable right arm strap 72 which extends onto the right front panel 24. The strap 72 is attached to the upper part of the back panel 22 by stitches 74 and is attached to the right front panel 24 by stitches 76.

There is an adjustable left arm strap 72 extending from the upper part of the back panel 22 onto the main part of the left front panel 26. Stitches 74 attach strap 72 to the upper part of the back panel 22 and stitches 76 attach strap 72 to the main body of the left front panel 26.

Figure 1:
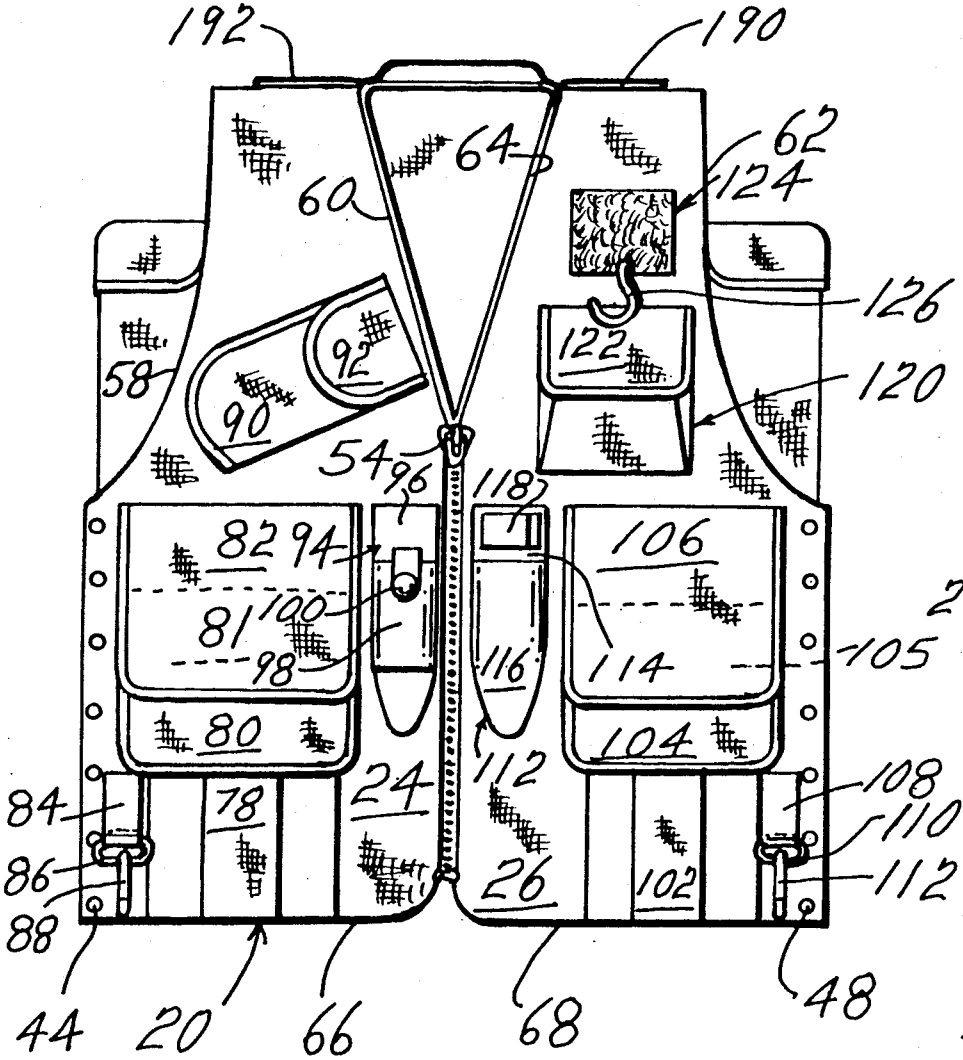
FIG. 1 is a front view of the vest and backpack combination.
Figure 4:
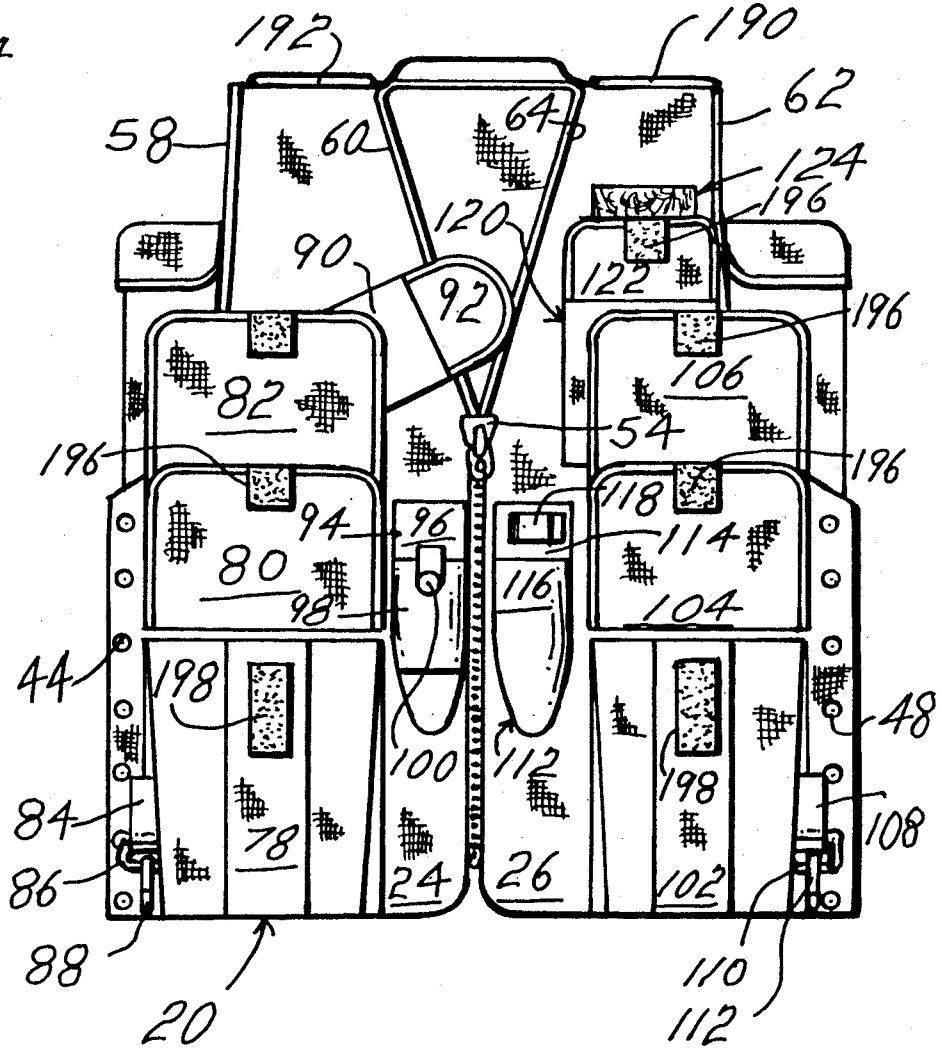
FIG. 4 is a front view with the front pockets open.
Figure 3:
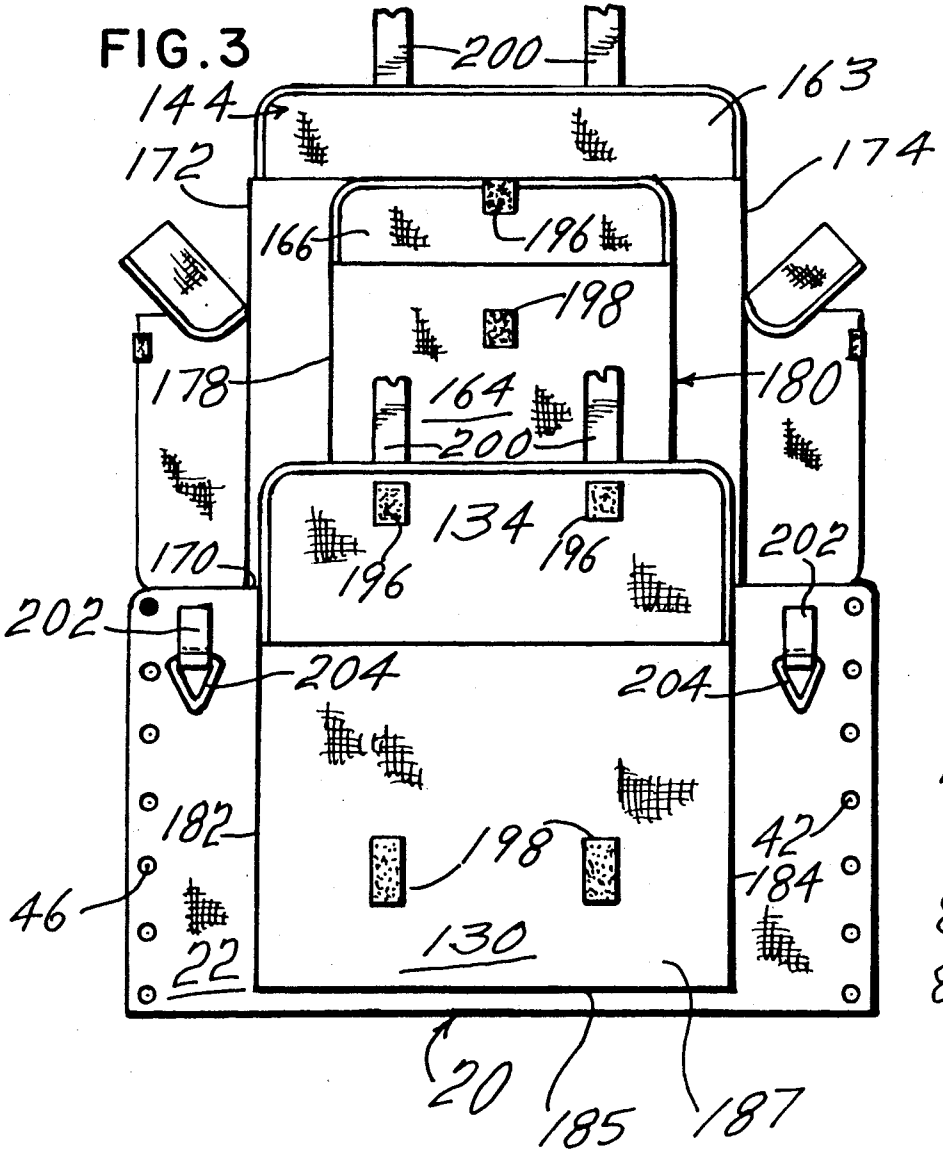
FIG. 3 is a rear view of the combination with the back pockets open.

With reference to FIGS. 1 and 4 it is seen that on the right front panel 24 that there is a lower pocket 78. There is a cover flap 80 for the lower pocket 78. Also, behind the lower pocket 78 and above the pocket 78 on the right front panel 24 there is an upper pocket 81, in phantom. There is a cover flap 82 for this upper pocket 81.

To the left of the lower pocket 78 there is a strap 84. The strap 84 connects with a metal or plastic loop 86. On the loop 86 there is a buckle 88 for attaching to items to be carried. The strap 84 may be sewn on to the right front panel 24 or may be attached by a strong adhesive to the panel 24.

On the upper part of the right front panel 24 and near both the inwardly curved side 58 and the inwardly curved side 60 there is an upper pocket 90 at a diagonal. The upper pocket 90 has a cover flap 92. The upper pocket 90 may be attached to the right front panel 24 by stitching or by a stronge adhesive.

To the right of the cover flap 82 and 80 and to the left of the first part 50 of the zipper there is a match pocket 94 having a base 96. The pocket 94 has a compartment 98 with a closing flap 100. The match pocket 94 can be used for carrying a cigarette lighter or a waterproof keeper for matches.

On the left front panel 26 there is a lower pocket 102 having a cover 104. Above the lower pocket 102 and behind the lower pocket 102 there is an upper pocket 105, in phantom, and having a cover 106. The cover 106 overlies the upper part of the cover 104, for the lower pocket 102.

To the right of the lower pocket 102 and to the left of the eyelet 44 there is a strap 108. On the lower part of the strap 108 there is a loop 110 of plastic or metal. A buckle 112 is attached to the loop 110. The pocket 102 and the upper pocket 105 behind the pocket 102 and the strap 108 can be attached to the left front panel 26 by stitching or by an adhesive.

To the left of the cover 104 and 106 and to the right of the second part of 52 the zipper there is a knife holder 112. 112 has a base 114, an open top pocket 116 and a loop 118. A knife can be placed in the pocket 116 and also inside the loop 118 to be securely positioned. The knife holder 112 can be attached to the left front panel 26 by stitching or by an adhesive.

Above the cover 106 and also above the knife holder 112 and between the inwardly curved side 62 and the inwardly curved side 64 there is a pocket 120 having a cover 122. The pocket 120 can be attached to the left front panel 26 by means of stitching or an adhesive.

Above the pocket 120 and between the inwardly curved side 62 and the inwardly curved side 64 there is a patch 124. The patch 124 has a hook 126 for holding on to various items. The patch 124 can be of "Velcro". For attaching items to the combination 20. The pockets 78 and the upper pocket 81 behind 78, the pocket 90, the pocket 102, and the upper pocket 105 behind the pocket 102, and the pocket 120 can be used for holding various items such as dry clothes, socks, a cap, some food, a flag of bright colors for observation from a distant point such as an airplane in case of an emergency rescue, ammunition, and similar items.

With respect to FIGS. 10,11,12,2,5,6, and 7 it is seen that on the outside of the back panel 22 that there is a lower attached pocket 130. FIGS. 10 and 11 are schematic illustrations. The upper part of the inner panel of the pocket 130 curves toward the back panel 22 and can be attached to the back panel 22 by stitching 132. There is a cover 134 for the pocket 130. The cover 134 can be attached to the back panel 22 by stitching 136.

The lower part of the pocket 130 is positioned away from the back panel 22 sa as to provide room for receiving a fanny pad 138. The fanny pad 138 can be stored between the back panel 22 and the lower pocket 130 or can be attached to the back panel 22 by stitching or an adhesive. A person out in the weather may want to sit down and eat lunch or sit down and rest. For example, in the woods it may be wet and a person may want to sit on a log or on a stump and rest or eat lunch. The log or stump may be wet and if a person sits on the wet log it may be uncomfortable. Therefor, the person can lower the fanny pad 138 and place the fanny pad 138 on the wet log or stump and sit on the fanny pad and be dry.

In FIG. 11 it is seen that on the upper part of the back panel 22 there is an upper lateral strip of Velcro 140 and a lower lateral strip of Velcro 142 on the outer surface.

In FIG. 10 it is seen that there is an upper detachable pocket 144 having a back panel 146. On the back panel 146 there is an upper lateral strip of Velcro 148 and on the lower part there is a lower lateral strip of Velcro 150. The pocket 144 can be attached to the back panel 22 by the upper lateral strip of Velcro 148 connecting with the lateral upper strip of Velcro 140 and the Velcro 150 on the pocket 142 can be connected to the Velcro 142 on the back panel 22. The pocket 144 has a front panel 152 which curves outwardly at the upper part 154. There is a flexible cover shield or flexible cover for the pocket 144. This illustrated in FIGS. 10 and 12. A first part 156 of the flexible cover is connected to the back panel 146. The first part 156 on its free end has a catch 158. The second part 160 of the flexible cover is connected to the part 154 of the front panel 152. The second part 160 on its free end has a second catch 162. The first catch 158 and the second catch 152 can be united to form a continuous cover over the interior of the pocket 1j4. Also, there is a cover 163 overlying the flexible cover and the pocket 144.

In FIG. 10 is is seen that on the front panel 152 of the pocket 144 there is an attached lower pocket 164 having a cover 166. The front panel 152 of the pocket 144 forms the back of the lower pocket 164.

The pocket 130 can be used for carrying different objects such as a tarp or food or ammunition or a cap. The pocket 144 can be removed from the combination 20 so as to lighten the combination 20 or can be attached to the back panel 22 for carrying objects such as clothing or a tarp or food or other objects. Likewise, the pocket 164 can be used for carrying various objects.

Figure 2:
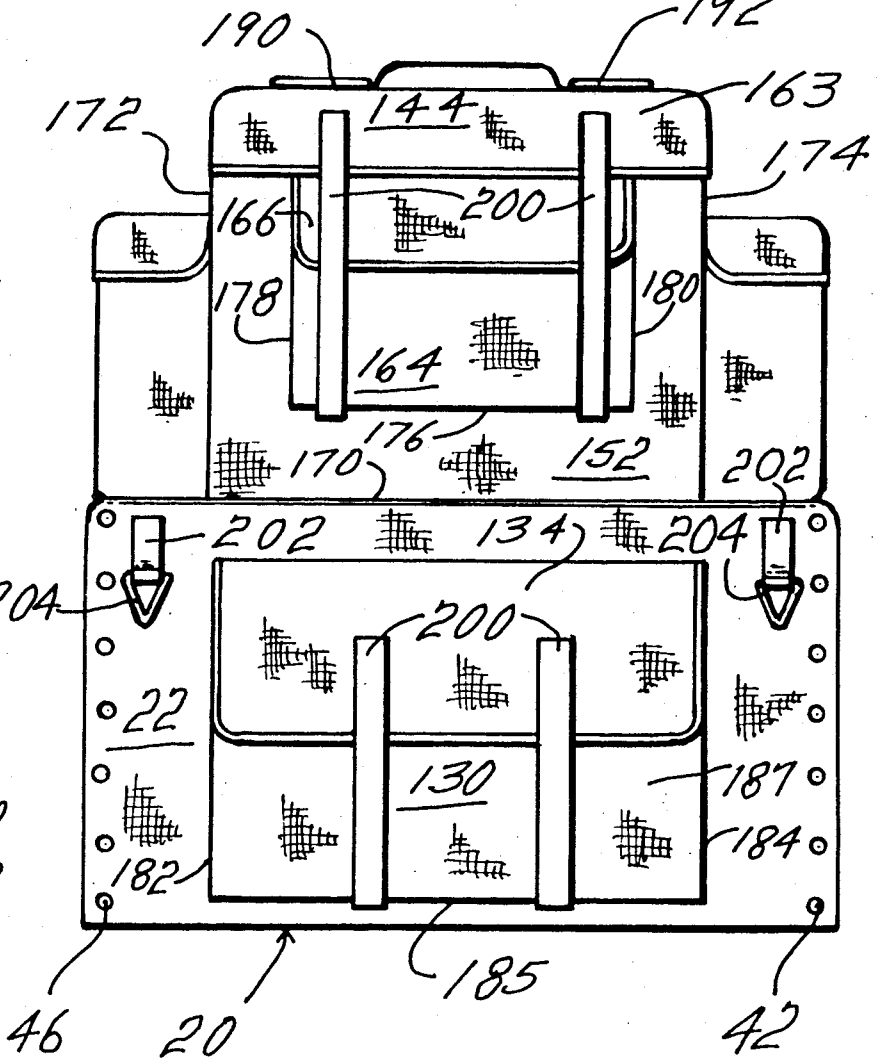
FIG. 2 is a rear view of the vest and backpack combination.

The upper pocket 144 has a bottom 170 and sides 172 and 174, see FIG. 2. This pocket can be used as a fish creel.

The pocket 164 has a bottom 176 and sides 178 and 180, see FIG. 8.

The pocket 130 has sides 182 and 184, see FIG. 8, a bottom 185 and a face member 187.

From the foregoing it is seen that I have provided a vest and backpack combination 20 having a safety feature in the back that this combination 20 is designed so that a wearer of it in a sparsely populated area can carry sufficient provisions to survive for approximately 8 days; and another object is to provide such a combination 20 for the hunter, the fisherman and a person who likes to backpack in sparsely populated regions and areas; a further object is to provide such a combination 20 which can have military applications for soldiers and people in the military; a further object is to provide a relatively light-in-weight combination 20 for a wearer of the combination; an additional object is to provide such a combination 20 which is made of a material which is waterproof and yet such material allows air circulation through itself; and, another additional and important object is to provide such a combination 20 which is adjustable to fit people of a wide ranges sizes and configurations so that only one or two sizes of the combination 20 need to be manufactured.

From the foregoing it is seen that this invention is directed to a vest and backpack combination 20. There is an upper detachable pocket 144 which makes it possible to lighten the combination 20. The combination 20 is designed to carry approximately 65 pounds. The necessities of the hunter or a fisherman or a military person can be carryed on or in the vest and the pockets. The combination 20 can be manufactured from 1000 denier cordura nylon. This material allows the combination 20 to breath and to pass air while preventing the passage of water or moisture. In other words it has the advantage of an air flow without the disadvantage of moisture passing thru the material. The combination 20 will not mildew or rust. The nylon will not mildew or rust and many of the materials are plastic and are not subject to rust and will not break under cold or pressure and can withstand heat. The nylon zipper will not rust and has a tension strength of approximately 600 pounds. There are pockets and holders for fish pliers and a knife and these can be made of a high grade saddle leather. Further, there is an inserted pocket for a rescue flag such as an orange silk flag. If the hunter or fisherman or soldier is lost this orange silk flag can be spread so that a person in a helicopter or an airplane can see the flag and make an emergency rescue. The shell pouches in the combination can carry approximately 25 shotgun shells. The combination is designed so that a hunter or fisherman or a military person can sustain himself in an isolated area and in the field for approximately 8 days. The pockets are double pleated so that a fisherman can carry all of his tackle boxes so as to leave free his hands to fish. Likewise, with the double pleated pockets a hunter can carry sheels and ammunition so as to leave free his hands to hunt. There is a fanny pad that pulls out from under the pocket 130 so that a person can sit on the fanny pad and be dry even though the fanny pad is resting on a wet log or a wet stump or a wet rock. In addition to the combination 20 having a sport application it can also be used in an industrial application by a person supervising men and having to keep records. The total weight of the combination is less than 3.5 pounds. There is a J hook 126 on the front of the combination for holding a fishing rod so that a fisher person can change lures or bait with both hands. It also has nylon snaps 88 and 112 to hold fishing nets or stringers. On the outer surface of the combination 20 and between the inwardly curved side 58 and inwardly curved side 60 there is a epaulet 190. Again, on the other surface of the combination 20 and between the inwardly curved side 62 and the inwardly curved side 64 there is an epaulet 192. The epaulets 190 and 192 can be attached by appropriate means to the material of the combination 20 and such appropriate means can be stitching or by suitable adhesive or by Velcro. The shoulder epaulets can hold game straps or can secure a slung rifle. As there are eyelets 42, 44, 46, 48 and the laces 56 it is possible to adjust the sides of the combination 20 to fit people of various sizes and configurations and also to allow a person to wear an under garment such as a sweater. This adjustability of the combination 20 makes it useful from the stand point that a person can wear the combination 20 without anything between the body and the combination or a person can be wearing clothes such as a shirt or a sweater or a jacket and yet the combination will fit over the clothes. In order to have the covers to the pockets firmly secured there is used Velcro. As is well known one form of Velcro is comprised of the first member 194 having loops and a second member 196 having hooks. These reference numerals are applied to the appropriate members of the pocket and the cover in the drawings. There are numerous straps 200 attached to the pockets for types of objects such as a small shovel, hatchet, bed roll and the like. On the back panel 22 there are two spaced apart straps 202. A triangular shaped eyelet 204 is attached to the strap 202. A string or small rope can be threaded through the eyelet 204 for tying to an article such as a canteen, a towel, an article of clothing and the like.

35 U.S.C. section 101, INVENTIONS PATENTABLE states; "Whoever invents or discovers any new and useful process, machine, manufacture, or composition of matter, or any new and useful improvement thereof, may obtain a patent therefor, subject to the conditions and requirements of this title."

35 U.S.C., CONDITIONS FOR PATENTABILITY; NON-OBVIOUS SUBJECT MATTER states; "A patent may not be obtained though the invention is not identically disclosed or described as set forth in sections 102 of this title, if the differences between the subject matter sought to be patented and the prior art are such that the subject matter as a whole would have been obvious at the time the invention was made to a person having ordinary skill in the art to which said subject matter pertains." "Patentability shall not be negatived by the manner in which the invention was made. Subject matter developed by another person, which qualifies as prior art only under subsection (f) or (g) of section 102 of this title, shall not preclude patentability under this section where the subject matter and the claimed invention were, at the time the invention was made, owned by the same person or subject to an obligation of assignment to the same name."

The combination 20 is new and useful. The applicant has not seen such a combination which can be used for hunting, fishing, backpacking and military personnel. The applicant has served in the military and has served as a guide for hunters and fisherman. From his experience he has developed this combination 20.

The invention is not obvious. Again, the applicant has not seen such a combination in his experience in the military, as a guide for hunters, fisherman and backpackers. The applicant has seen many forms of gear for people hunting, fishing and backpacking; there are tarps, jackets and the like for these people. However, the applicant has never seen the combination that he is trying to patent.

From the foregoing disclosure it is seen that I have provided a backpack combination comprising a back panel, a right front panel, a left front panel, said back panel, said right front panel, and said left front panel being unitary; said back panel, said right front panel, and said left front panel in an outstretched state presenting; said back panel having a side juxtapositioned to said right front panel; said right front panel having a side juxtapositioned to said back panel; a first mechanical means for attaching the side of said back panel juxtapositioned to said right front panel and the side of said right front panel juxtapositioned to said back panel, adjacent to each other; said back panel having a side juxtapositioned to said left front panel and said left front panel having a side juxtapositioned to said back panel; a second mechanical means for attaching said side of said back panel juxtapositioned to said left front panel and the side of said left front panel juxtapositioned to said back panel, adjacent to each other; said right front panel having a side juxtapositioned to said left front panel; said left front panel having a side juxtapositioned to said right front panel; a third mechanical means for attaching said side of right front panel juxtapositioned to said left front panel and said side of left front panel juxtapositioned to said right front panel adjacent, to each other; a first pocket on said back panel; and, a second pocket on one of the front panels. Said first mechanical means and said second mechanical means a lace for said first mechanical means; and a lace for said second mechanical means. In said combination said first mechanical means being first eyelets in the side of said back panel juxtapositioned to said right front panel and being second eyelets in the side of said right front panel juxtapositioned to said back panel; a lace passing through said first eyelets and through said second eyelets; said second mechanical means being third eyelets in said side of said back panel adjacent to said left front panel and being fourth eyelets in the side of said left front panel juxtapositioned to said back panel; and a lace passing through said third eyelets and through said fourth eyelets. In said combination said back panel, said right front panel and said left front panel being of a material pervious to a gas and impervious to a liquid. In said combination there being a plurality of pockets on said right front panel; a plurality of pockets on said left front panel; a plurality of pockets on said back panel; a bracket on one of said front panels; a hook on one of said front panels; a fanny pad operatively connecting with said back panel; an adjustable right arm strap operatively connecting with said back panel and said right front panel to assist in distributing a load; and, a adjustable left arm strap operatively connecting with said back panel and said left front panel to assist in distributing a load.

Further, it is seen that I have provided a process for making a backpack combination, wherein said process comprises selecting a material; processing said material into a unitary back panel, a right front panel and a left front panel; in an outstretched state said back panel. Said right front panel and said left front panel present a "Y" configuration; forming said back panel with a side juxtapositioned to said right front panel; forming said right front panel with a side juxtapositioned to said back panel; forming a first mechanical means for attaching, said side of said back panel juxtapositioned to said right front panel and said side of said right front panel juxtapositioned to said back panel, adjacent to each other; forming said back panel with a side juxtapositioned to said left front panel; forming said left front panel with a side juxtapositioned to said back panel; forming a second mechanical means for attaching, the side of said back panel juxtapositioned to said left front panel and the side of the said left front panel juxtapositioned to said back panel, adjacent to each other; forming said right front panel with a side juxtapositioned to said left front panel; forming said left front panel with a side juxtapositioned to the right front panel; forming a third mechanical means for attaching, said side of said right front panel juxtapositioned to said left front panel and the side of said left front panel juxtapositioned to said right front panel, adjacent to each other; forming a first pocket in said back panel; forming a second pocket on one of said left front panels. Further, there has been disclosed the positioning of a plurality of pockets on said right front panel; positioning a plurality of pockets on said left front panel; positioning a plurality of pockets on said back panel; positioning a bracket on one of said front panels; positioning a hook on one of said front panels; operatively connecting a fanny pad with said back panel; operatively connecting an adjustable right arm strap with said back panel and said right front panel to assist in distributing a load; and, operatively connecting an adjustable left arm strap with said back panel and said left front panel to assist in distributing a load.

Also, it is seen that I have provided a process for making a backpack combination made by process comprising selecting a material; processing said material into a unitary back panel, a right front panel and a left front panel. In an outstretched state said back panel, said right front panel and said left front panel presenting a "Y" configuration forming said back panel with a side juxtapositioned to said right front panel; forming said right front panel with a side juxtapositioned to said back panel; forming a first mechanical means for attaching, said side of said back panel juxtapositioned to said right front panel and the side of said right front panel juxtapositioned to said back panel, adjacent to each other; forming said back panel with a side juxtapositioned to said left front panel; forming said left front panel with a side juxtapositioned to said back panel; forming a second mechanical means for attaching, said side of said back panel juxtapositioned to said left front panel and the side of said left front panel juxtapositioned to said back panel, adjacent to each other; forming said right front panel with a side juxtapositioned to said left front panel; forming said left front panel with a side juxtapositioned to said right front panel; forming a third mechanical means for attaching, the side of said right front panel juxtapositioned to said left front panel and the side of said left front panel juxtapositioned to said right front panel, adjacent to each other; forming a first pocket in said back panel; and, forming a second pocket on one of said front panels.

What I claim is:

1. A backpack and vest combination comprising:
A. a back panel;
B. a right front panel;
C. a left front panel;
D. said back panel, said right front panel, and said left front panel being of unitary construction;
E. said back panel, said right front panel, and said left front panel when laid out flat presenting a "Y" configuration;
F. said back panel having a side juxtapositioned to said right front panel;
G. said right front panel having a side juxtapositioned to said back panel;
H. a first mechanical means for attaching said side of said back panel juxtapositioned to said right front panel and said side of said right front panel juxtapositioned to said back panel adjacent to each other;
I. said back panel having a side juxtapositioned to said left front panel;
J. said left front panel having a side juxtapositioned to said back panel;
K. a second mechanical means for attaching said side of said back panel juxtapositioned to said left front panel and said side of said left front juxtapositioned to said back panel adjacent to each other;
L. said right front panel having a side juxtapositioned to said left front panel;
M. said left front panel having a side juxtapositioned to said right front panel;
N. a third mechanical means for attaching said side of said right front panel juxtapositioned to said left front panel and said side of said left front panel juxtapositioned to said right front panel adjacent to each other;
O. a first pocket on said back panel; and,
P. a second pocket on one of the front panels.

2. A combination according to claim 1 and comprising:
A. said first mechanical means and said second mechanical means comprising an attaching means;
B. a lace for said first mechanical means; and,
C. a lace for said second mechanical means.

3. A combination according to claim 1 and comprising:
A. said first mechanical means being first eyelets in said side of said back panel juxtapositioned to said right front panel and being second eyelets in said side of said right front panel juxtapositioned to said back panel;
B. a lace passing through said first eyelets and through said second eyelets;
C. said second mechanical means being third eyelets in said side of said back panel juxtapositioned to said left front panel and being fourth eyelets in said side of said left front panel juxtapositioned to said back panel; and,
D. a lace passing through said third eyelets and through said fourth eyelets.

4. A combination according to claim 2 and comprising:
A. said back panel, said right front panel and said left front panel being of a material pervious to a gas and impervious to a liquid.

5. A combination according to claim 3 and comprising:
A. said back panel, said right front panel and said left front panel being of a material pervious to a gas and impervious to a liquid.

6. A combination according to claim 2 and comprising:
A. said second pocket being on said right front panel;
B. a third pocket on said left front panel; and,
C. a removeable fourth pocket on said back panel.

7. A combination according to claim 3 and comprising:
A. said second pocket being on said right front panel;
B. a third pocket on said left front panel; and,
C. a removeable fourth pocket on said back panel.

8. A combination according to claim 4 and comprising:
A. a plurality of pockets on said right front panel;
B. a plurality of pockets on said left front panel;
C. a plurality of pockets on said back panel;
D. a bracket on one of said front panels;
E. a hook on one of said front panels;
F. a fanny pad operatively connecting with said back panel;
G. an adjustabale right arm strap operatively connecting with said back panel and said right front panel to assist in distributing a load; and,
H. an adjustable left arm strap operatively connecting with said back panel and said left front panel to assist in distributing a load.

9. A combination according to claim 5 and comprising:
A. a plurality of pockets on said right front panel;
B. a plurality of pockets on said left front panel;
C. a plurality of pockets on said back panel;
D. a bracket on one of said front panels;
E. a hook on one of said front panels;
F. a fanny pad operatively connecting with said back panel;
G. an adjustable right arm strap operatively connecting with said back panel and said right front panel to assist in distributing a load; and, H. an adjustable left arm strap operatively connecting with said back panel and said left front panel to assist in distributing a load.

10. A process for making a backpack and vest combination, said process comprising:

A. selecting a material;

B. processing said material into a back panel, a right front panel and a left front panel of unitary construction;

C. when laid out flat said back panel, said right front panel and said left front panel present a "Y" configuration;

D. forming said back panel with a side juxtapositioned to said right front panel;

E. forming said right front panel with a side juxtapositioned to said back panel;

F. forming a first mechanical means for attaching said side of said back panel juxtapositioned to said right front panel and said side of said right front panel juxtapositioned to said back panel adjacent to each other;

G. forming said back panel with a side juxtapositioned to said left front panel;

H. forming said left front panel with a side juxtapositioned to said back panel;

I. forming a second mechanical means for attaching said side of said back panel juxtapositioned to said left front panel and said side of said left front panel juxtapositioned to said back panel adjacent to each other;

J. forming said right front panel with a side juxtapositioned to said left front panel;

K. forming said left front panel with a side juxtapositioned to said right front panel;

L. forming a third mechanical means for attaching said side of said right front panel juxtapositioned of said left front panel and said side of said left front panel juxtapositioned to said right front panel adjacent to each other;

M. forming a first pocket on said back panel; and,

N. forming a second pocket on one of said front panels.

11. A process according to claim 10 and comprising:

A. said first mechanical means and said second mechanical means comprising an attaching means;

B. a lace for said first mechanical means; and,

C. a lace for said second mechanical means.

12. A process according to claim 10 and comprising;

A. said first means being first eyelets in said side of said back panel juxtapositioned to said right front panel and being second eyelets in said side of said right front panel juxtapositioned to said back panel;

B. passing a lace through said first eyelets and through said second eyelets;

C. said second mechanical means being third eyelets in said side of said back panel juxtapositioned to said left front panel and being fourth eyelets in said side of said left front panel juxtapositioned to said back panel; and, D. passing a lace through said third eyelets and through said fourth eyelets.

13. A process according to claim 11 and comprising:

A. selecting said back panel, said right front panel and said left front panel of a material pervious to a gas and impervious to a liquid.

14. A process according to claim 12 and comprising:

A. selecting said back panel, said right front panel and said left front panel of a material pervious to a gas and impervious to a liquid.

15. A process according to claim 11 and comprising:

A. positioning said second pocket on said right front panel;

B. positioning a third pocket on said left front panel; and,

C. positioning a removeable fourth pocket on said back panel.

16. A process according to claim 12 and comprising:

A. positioning said second pocket on said right front panel;

B. positioning a third pocket on said left front panel; and,

C. positioning a removeable fourth pocket on said back panel.

17. A process according to claim 13 and comprising:

A. positioning a plurality of pockets on said right front panel;

B. positioning a plurality of pockets on said left front panel;

C. positioning a plurality of pockets on said back panel;

D. positioning a bracket on one of said front panels;

E. positioning a hook on one of said front panels;

F. operatively connecting a fanny pad with said back panel;

G. operatively connecting an adjustable right arm strap with said back panel and said right front panel to assist in distributing a load; and, H. operatively connecting an adjustable left arm strap with said back panel and said left front panel to assist in distributing a load.

18. A process according to claim 14 and comprising:

A. positioning a plurality of pockets on said right front panel;

B. positioning a plurality of pockets on said left front panel;

C. positioning a plurality of pockets on said back panel;

D. positioning a bracket on one of said front panels;

E. positioning a hook on one of said front panels;

F. operatively connecting a fanny pad with said back panel;

G. operatively connecting an adjustable right arm strap with said back panel and said right front panel to assist in distributing a load; and, H. operatively connecting an adjustable left arm strap with said back panel and said left front panel to assist in distributing a load.

19. A backpack and vest combination made by a process comprising:

A. selecting a material;

B. processing said material into a back panel, a right front panel and a left front panel of unitary construction;

C. when laid out flat said back panel, said right front panel and said left front panel present a "Y" configuration;

D. forming said back panel with a side juxtapositioned to said right front panel;

E. forming said right front panel with a side juxtapositioned to said back panel;

F. forming a first mechanical means for attaching said side of said back panel juxtapositioned to said right front panel and said side of said right front panel juxtapositioned to said back panel adjacent to each other;

G. forming said back panel with a side juxtapositioned to said left front panel;

H. forming said left front panel with a side juxtapositioned to said back panel;

I. forming a second mechanical means for attaching said side of said back panel juxtapositioned to said left front panel and said side of said left front panel juxtapositioned to said back panel adjacent to each other;

J. forming said right front panel with a side juxtapositioned to said left front panel;

K. forming said left front panel with a side juxtapositioned to said right front panel;

L. forming a third mechanical means for attaching said side of said right front panel juxtapositioned to said left front panel and said side of said left front panel juxtapositioned to said right front panel adjacent to each other;

M. forming a first pocket on said back panel; and,

N. forming a second pocket on one of said front panels.

20. A backpack and vest combination made by a process according to claim 19 and comprising:

A. said first mechanical means and said second mechanical means comprising an attaching means;

B. a lace for said first mechanical means; and,

C. a lace for said second mechanical means.

21. A backpack and vest combination made by a process according to claim 20 and comprising:

A. said first mechanical means being first eyelets in said side of said back panel juxtapositioned to said right front panel and being second eyelets in said side of said right front panel juxtapositioned to said back panel;

B. passing a lace through said first eyelets and through said second eyelets;

C. said second mechanical means being third eyelets in said side of said back panel juxtapositioned to said left front panel and being fourth eyelets in said side of said left front panel juxtapositioned to said back panel; and, D. passing a lace through said third eyelets and through said fourth eyelets.

22. A backpack and vest combination made by a process according to claim 20 and comprising:

A. selecting said back panel, said right front panel and said left front panel of a material pervious to a gas and impervious to a liquid.

23. A backpack and vest combination made by the process according to claim 21 and comprising:

A. selecting said back panel, said right front panel and said left front panel of a material pervious to a gas and impervious to a liquid.

24. A backpack and vest combination made by a process according to claim 20 and comprising:

A. positioning said second pocket on said right front panel;

B. positioning a third pocket on said left front panel; and,

C. positioning a removable fourth pocket on said back panel.

25. A backpack and vest combination made by a process according to claim 21 and comprising:

A. positioning said second pocket on said right front panel;

B. positioning a third pocket on said left front panel; and,

C. positioning a removable fourth pocket on said back panel.

26. A backpack and vest combination made by a process according to claim 22 and comprising:

A. positioning a plurality of pockets on said right front panel;

B. positioning a plurality of pockets on said left front panel;

C. positioning a plurality of pockets on said back panel;

D. positioning a bracket on one of said front panels;

E. positioning a hook on one of said front panels;

F. operatively connecting a fanny pad with said back panel;

G. operatively connecting an adjustable right arm strap with said back panel and said right front panel to assist in distributing a load; and, H. operatively connecting an adjustable left arm strap with said back panel and said left front panel to assist in distributing a load.

27. A backpack and vest combination made by a process according to claim 23 and comprising:

A. positioning a plurality of pockets on said right front panel;

B. positioning a plurality of pockets on said left front panel;

C. positioning a plurality of pockets on said back panel;

D. positioning a bracket on one of said front panels;

E. positioning a hook on one of said front panels;

F. operatively connecting a fanny pad with said back panel;

G. operatively connecting an adjustable right arm strap with said back panel and said right front panel to assist in distributing a load; and, H. operatively connecting an adjustable left arm strap with said back panel and said left front panel to assist in distributing a load.

* * * * *